350-285 SR
5/25/87 XR 4,669,034

United States Patent [19]

Bansbach et al.

[11] Patent Number: 4,669,034

[45] Date of Patent: May 26, 1987

[54] NON-GLARE DEVICE FOR LARGE SURFACE LIGHT EMITTING MEANS

[75] Inventors: Armin Bansbach; Dieter Albert, both of Berlin, Fed. Rep. of Germany

[73] Assignee: Semperlux GmbH, Berlin, Fed. Rep. of Germany

[21] Appl. No.: 796,581

[22] Filed: Nov. 8, 1985

[30] Foreign Application Priority Data

Feb. 13, 1985 [DE] Fed. Rep. of Germany ... 8504325[U]

[51] Int. Cl.[4] ..... F21V 7/00

[52] U.S. Cl. ..... 362/309; 362/340; 362/311; 362/339; 352/286

[58] Field of Search ..... 362/327, 339, 308, 309, 362/333, 337, 292, 340, 244, 245, 326, 329, 310; 350/286

[56] References Cited

U.S. PATENT DOCUMENTS

| | | | |
|---|---|---|---|
| 616,400 | 12/1898 | Burger | 362/332 |
| 1,596,161 | 8/1926 | Dorey | 362/309 |
| 2,003,804 | 6/1935 | Falge | 362/311 |
| 2,015,235 | 9/1935 | Rolph | 362/340 |
| 3,646,338 | 2/1972 | Goytisolo | 362/309 |
| 4,118,763 | 10/1978 | Osteen | 362/326 |
| 4,462,068 | 7/1984 | Shedwick | 362/340 |

FOREIGN PATENT DOCUMENTS

| | | | |
|---|---|---|---|
| 138828 | 9/1950 | Australia | 362/327 |
| 256197 | 10/1926 | United Kingdom | 362/339 |
| 429340 | 5/1935 | United Kingdom | 350/286 |

*Primary Examiner*—William A. Cuchlinski, Jr.
*Assistant Examiner*—D. M. Cox
*Attorney, Agent, or Firm*—Michael J. Striker

[57] ABSTRACT

A non-glare screen is assembled of prismatic rings stacked one on the other and coaxially enclosing a light emitting surface. Each ring has a cross-section of a right triangle. One leg of the triangle is perpendicular to the axis of the light emitting surface and the hypoteruse forms with the one leg an angle between 35° to 45°, preferably 40°.

8 Claims, 14 Drawing Figures

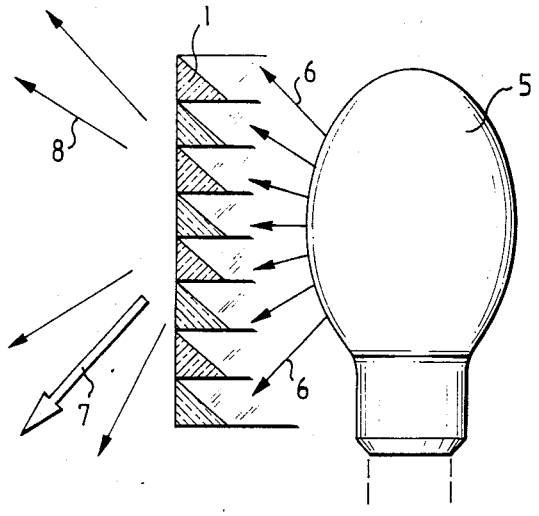
FIG. 2
FIG. 3
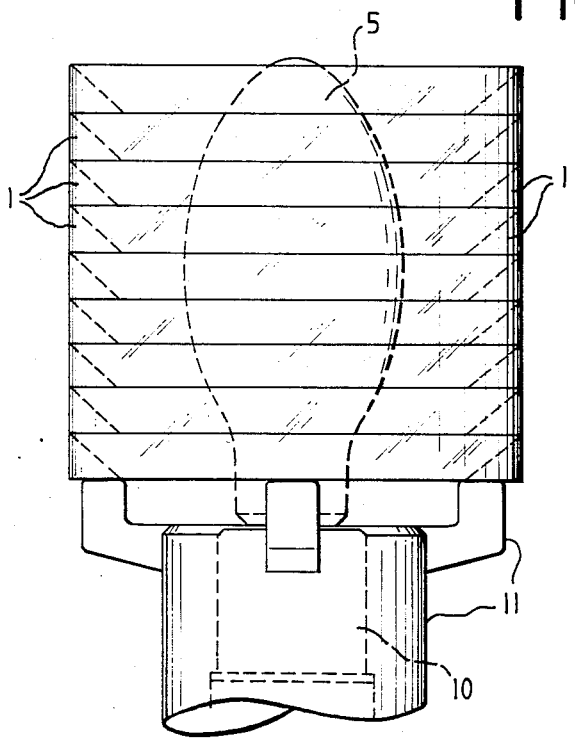

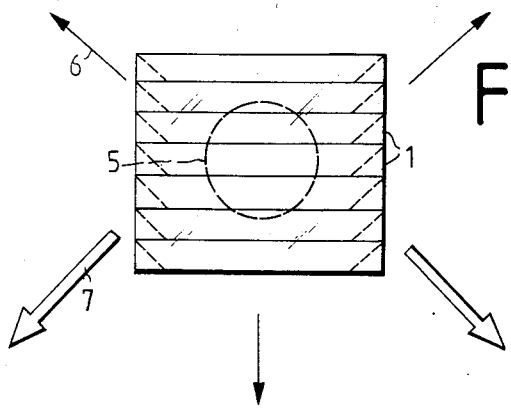
FIG.4a
FIG.4b
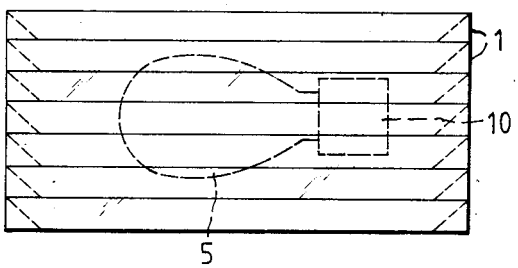
FIG.5a
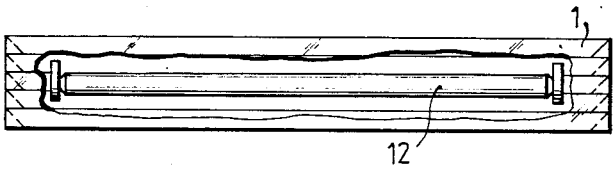
FIG.5b
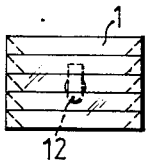

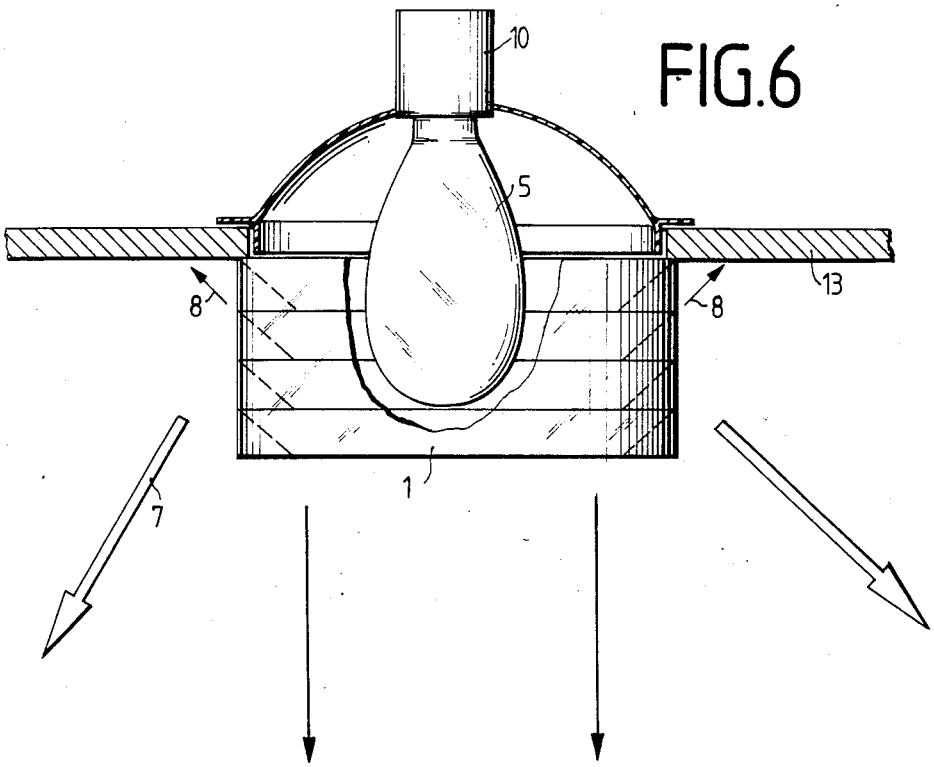
FIG.6
FIG.7
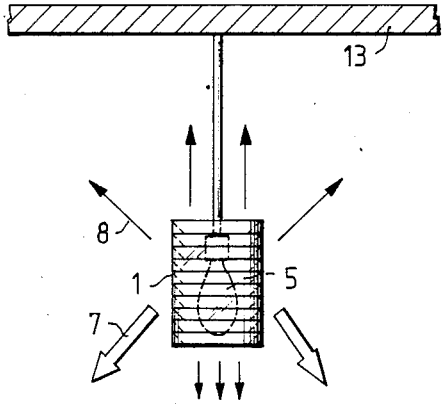

NON-GLARE DEVICE FOR LARGE SURFACE LIGHT EMITTING MEANS

BACKGROUND OF THE INVENTION

The present invention relates in general to interior-or exterior illumination means having a large light emitting surface extending around an axis, and in particular, to a device for eliminating glare of such illumination means.

In designing interior or exterior illuminating appliances effort is made to improve visual comfort and to achieve a high degree of illumination. For this purpose, lamps having a high light density must be free of glare. The elimination of glare is particularly needed in the case of large light emitting surfaces in matted incandescent lamps, mercury vapor high pressure lamps or fluorescent lamps, for example. Known non-glare measures employ an arrangement of simple screens, mirror systems and prismatic systems. The mirror systems and the prism systems, in general have the advantage that light, instead of being wasted by absorption, is deviated in the desired direction. Conventional prism systems, however, are disadvantageous for use in connection with a large light emitting surface which, for structural reasons, must lie very close to the prisms.

In this case, light rays cannot be prevented from impinging on the prisms from different angles and also from being dispersed in an uncontrollable manner, thus strongly imparing the desired effect.

SUMMARY OF THE INVENTION

It is, therefore, a primary object of this invention to avoid the disadvantages of prior art non-glare prism systems.

In particular, it is an object of this invention to provide an improved non-glare prism system which, in spite of a close proximity of large area lamps or light emitting means opposite the prisms, provides a controlled path of incoming and reflected rays.

Another object of this invention is to provide such an improved prism system which permits a non-glare exit of lateral rays at an angle up to 30° to a horizontal.

These objects and others which will become apparent hereafter, are achieved, in accordance with this invention, by providing a non-glare shield including at least one prism arranged opposite the light emitting surface, the prism having leg sides including an angle of 90°, one leg side being substantially perpendicular to the axis of the light emitting surface and the other leg side extending substantially parallel with the axis, and a hypotenuse side including with the one leg side an angle between 35° and 45°, preferably 40°.

In the preferred embodiment of this invention, the nonglare shield is assembled of a stack of annular prisms symmetrically enclosing the entire light emitting surface. With a perpendicular lamp, the prisms are superposed one above the other whereby the other leg side extends parallel with a horizonal. The prisms are rigidly or detachably connected with one another. With advantage, the horizontal sides are roughened or covered with opaque layers.

The novel features, which are considered as characteristic of this invention, are set forth in the appended claims. The invention itself, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a schematic front view of an upright large area light emitter with a non-glare device of this invention;

FIG. 3 is a front view of an upright lamp of ellipsoid configuration in combination with a rectangular non-glare screen of this invention;

FIG. 4*a* and 4*b* show, respectively, front and side views of a horizontally oriented lamp of ellipsoid configuration with a rectangular prismatic screen;

FIGS. 5*a* and 5*b* show respectively, front and side views of a fluorescent lamp with a rectangular prismatic screen;

FIG. 6 is a schematic illustration of a light emitter built in a ceiling and provided with a cylindrical prismatic screen of this invention;

FIG. 7 shows an arrangement of a suspended light emitter with a cylindrical prismatic screen;

DESCRIPTION OF THE PREFERRED EMBODIMENTS

Figure 1:
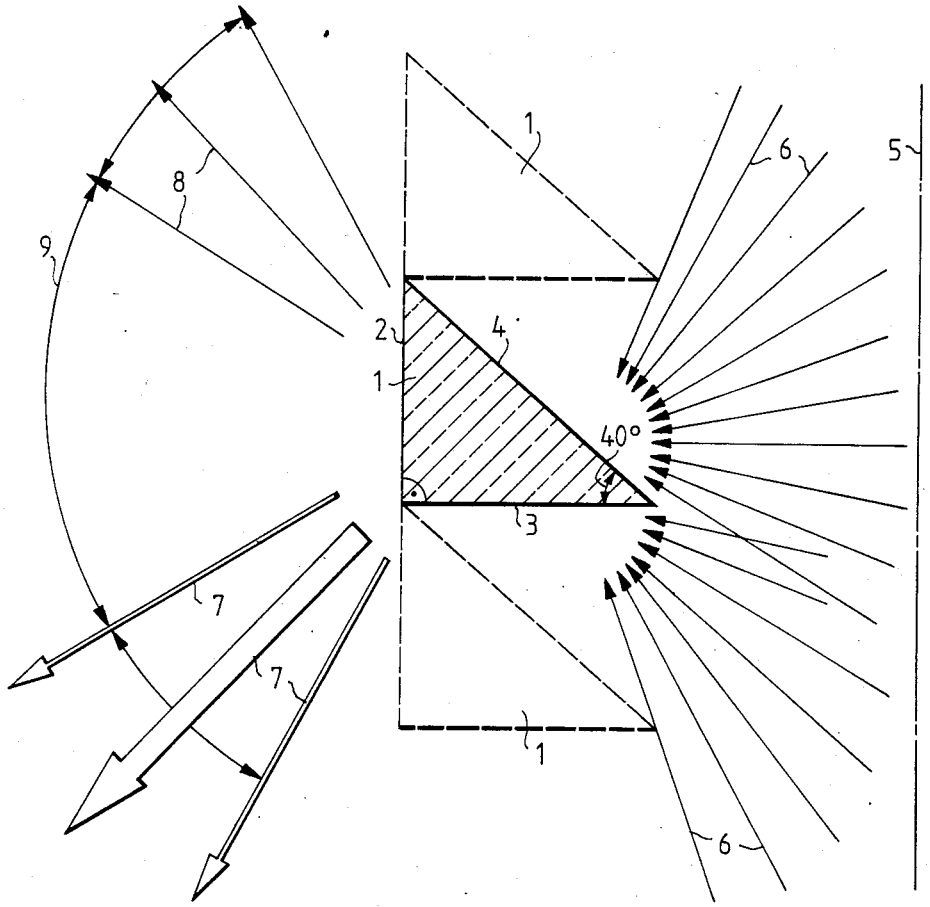
FIG. 1 is a schematic sectional view of a prism arrangement according to this invention.

Referring to FIG. 1, the illustrated transparent triangular prism 1 has an upright leg side 2 and a horizontal leg side 3, the two leg sides forming an angle of 90°. A hypotenuse side 4 forms with the horizontal side 3 an acute angle of 40°. The elimination of glare is achieved owing to the total reflection in the interior of prism 1 and by refraction of light rays 6 emanating from large area illumination means 5, indicated by a dash-dot line. Rays 6 impinge on prism 1 from different directions whereby a strong light reflection 7 occurs at the lower range of the prism opposite the hypotenuse side 4, and a weak reflection 8 takes place in the upper range of the prism substantially parallel to the hypotenuse side. In the intermediate range 9, there is practically no reflection or radiation at all whereby no light is wasted by absorption.

It has been found in a series of experiments that the achieved elimination of glare is optimum at the shown acute angle of 40°. A minute dispersion of efficiency depends on the index of refraction of the employed transparent material of the prism, namely of a glass-clear plastics or a mineral glass.

A prismatic screen for eliminating glare from large area illumination means is assembled of a plurality of prisms stacked one on the other along a center axis of a bulb 5, as shown in FIG. 2. In principle, it is possible to use a single prism 1 of such a size as to cover the entire height of the bulb.

Theoretically, such a single prism screen exhibits minimum interferences due to radii of curvature of the edges of the prism which are unavoidable in actual prisms. Nevertheless, for manufacturing reasons and to save material, the screen of this invention is assembled of superposed prismatic rings, square or angular frames and the like to form a corresponding prismatic tube.

Preferably, the superposed prisms 1 enclose the upright or horizontal illumination means 5 symmetrically around its center axis. FIG. 3 shows an upright ellipsoid light emitter 5 coaxially arranged in a non-glare screen of superposed prisms 1. The ellipsoid lamp 5 is mounted in a fitting 10 which also supports in a conventional manner a fixing member 11 for the prismatic screen.

The ellipsoid lamp 5, of course, can be also mounted horizontally in a rectangular prismatic screen, as indicated in FIGS. 4*a* and 4*b*. The screen is again assembled of superposed prismatic frames forming together a screening column. In the same manner is screened a fluorescent lamp 12 shown in FIGS. 5*a* and 5*b*. The configuration and construction of the non-glare screen 1 is the same as for the ellipsoid lamp of FIGS. 4*a* and 4*b*.

The same advantages are obtained with the screen assembly of FIG. 6 used for a light radiator built in a ceilings. In this embodiment, a fitting 10 and ellipsoid lamp 5 are arranged in an opening of a ceiling plate 13. A top part of the lamp projects below the plate 13 and is surrounded by the screen of this invention, assembled of annular prisms 1. The arrows indicate that no radiation takes place in the intermediate part of lateral walls of the screen. Most rays are radiated downwards (arrow 7) and a lesser amount of rays is directed upwards (arrow 8) to brighten ceiling plates 13.

FIG. 7 shows a pendulum light emitter suspended from a ceiling 13. A large area illumination member 5 is coaxially surrounded by a cylindrical screen assembled of superposed prismatic rings. The screen can be made either of a stack of individual rings or as a single piece with integral prisms. The one piece screen is also free of lateral radiation from the intermediate part of its jacket.

Figure 8:
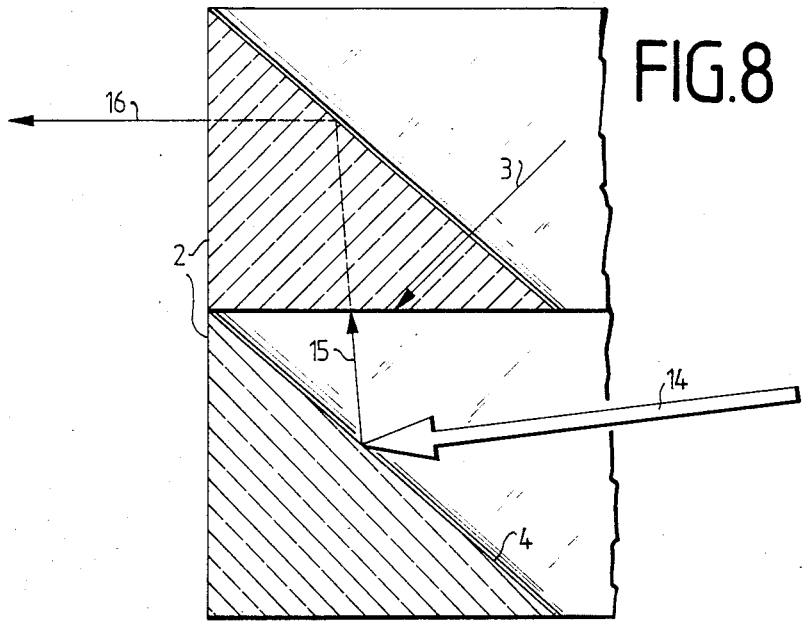
FIG. 8 illustrates schematically incorrect light ray paths causing glare.

In the case of large surface light sources of high intensity, particularly in external illuminating means, an undesired glaring effect may occur as indicated by arrows in the superposed prisms of FIG. 8. Light rays 14 exiting from an illumination means can be reflected from the hypotenuse side 4 of one prism against the horizontal leg side 3 of the superposed prism. The reflected rays 15 pass through the superposed prism and are again reflected from the hypotenuse side of the latter through the upright side 2, exiting as a lateral radiation 16.

In a modification of this invention, the occurrence of above described dazzling radiation 16 is prevented by matting or blackening the horizontal leg sides of the superposed prisms so that no reflected rays 15 can pass therethrough. In another modification shown in FIG. 9 opaque intermediate annular foils or rings 17 are inserted below the horizontal leg sides 3 between respective prisms. In this manner, a complete elimination of lateral glaring radiation is achieved.

Figure 9:
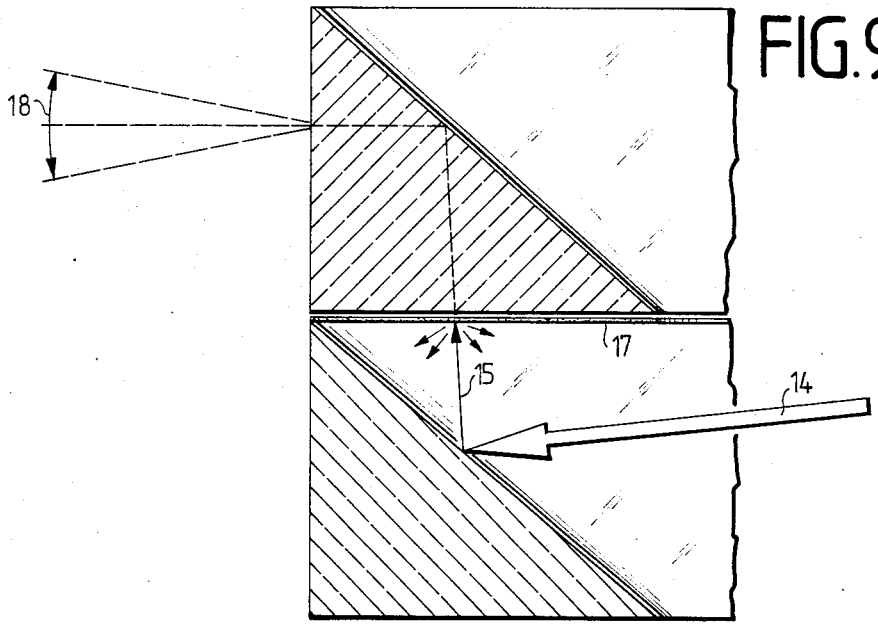
FIG. 9 shows the effect of intermediate rings in the prismatic screen on the rays of FIG. 8.

If desired, the lateral radiation can be utilized for obtaining various color effects by using transparent color layers 17 on the horizontal leg sides. The prismatic screen by itself becomes luminant in the corresponding color while the reflected light rays 7 and 8 leave the prismatic shield without any coloration. The coloration of the screen is due to color light rays exiting within a relatively small angular range 18 (FIG. 9). The intermediate color layers 17 can be also in the form of thin rings inserted between contact areas of respective prisms without any additional support.

Figure 10:
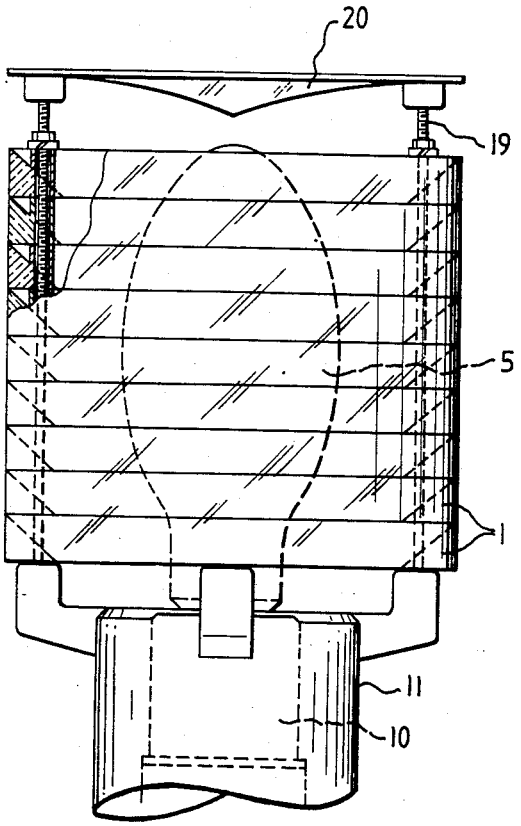
FIG. 10 is a view similar to FIG. 3 showing a cylindrical prismatic screen with intermediate rings and top mirrors.

As mentioned before, the non-glare screen of this invention can be made as a single piece cylindrical shell with individual prisms integrally formed in its jacket. Better results, however, are obtained when discrete prismatic rings 1 are stacked one above the other and clamped together by threaded rods 19. In this manner the roundness of annular edges of the prisms can be made more precise. Such an arrangement is illustrated in FIG. 10, showing an upright bulb 5 in a fitting 10 and cylindrical prismatic screen in which superposed annular prisms are held together by threaded rods 19. A support 11 attached to fitting 10 held the screen coaxially around the lamp 5. In this embodiment, there is provided a top mirror or heat shield 20. The heat shield is suitable particularly for spherical illumination means and prismatic non-glare shield made of plastics.

Figure 11A:
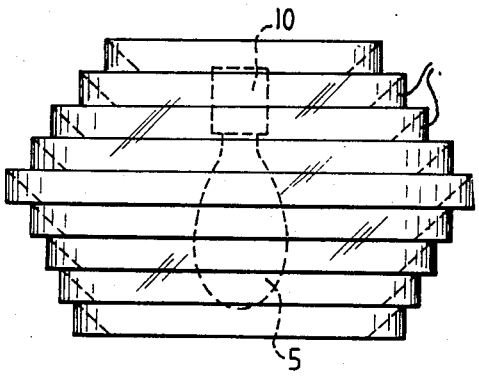
FIGS. 11*a* and 11*b* show side views of annular prismatic screens assembled of prisms of different diameters.
Figure 11B:
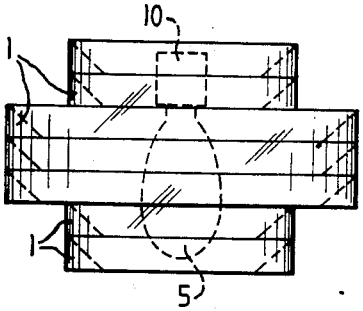

As seen from FIGS. 11*a* and 11*b*, the non-glare shield can be assembled of annular prisms of different diameters so that the contour of the shield is no longer cylindrical. The profiled shields result in interstring designs suitable particularly for spherical lamps.

What is claimed as new and desired to be protected by Letters Patent is set forth in the appended claims:

1. A device for eliminating glare from exterior or interior illumination means having a large light emitting surface extending around an axis, comprising a plurality of annular prisms of a triangular cross-section, said prisms being coaxially stacked one on the other to form a cylindrical screen surrounding said light emitting surface, the triangular cross-section of each of said prisms defining two leg sides including an angle of 90°, one leg side being directed substantially perpendicularly toward said axis, the other leg side extending substantially parallel with said axis and coinciding with the outer surface of said cylindrical screen, and a hypotenuse said including with said one leg side an angle between 35° and 45°, preferably 40°.

2. A device as defined in claim 1 wherein each of said prisms has the shape of an oval ring.

3. A device as defined in claim 1, wherein each of said prisxs has a shape of an angular frame.

4. A device as defined in claim 1, wherein said one leg side in each prism is roughened or blackened to prevent passage of light.

5. A device as defined in claim 1 wherein color foils are arranged between the stacked prisms.

6. A device as defined in claim 1 wherein the stacked prisms are of different diameters.

7. A device as defined in claim 1 wherein said annular prisms have an identical shape.

8. A device for eliminating glare from illumination means having a large light emitting surface extending around an axis, comprising a non-glare screen including a plurality of annular prisms of a triangular cross-section, said prisms being stacked one on the other and coaxially enclosing the light emitting surface, the cross-section of said prism having two leg sides including an angle of 90°, one lege being substantially perpendicular to said axis and the other leg side extending substantially parallel with said axis, and a hypotenuse side including with said one leg side an angle between 35° and 45°, preferably 40°, and further comprising annular foils arranged between the stacked prisms.

* * * * *